US008755720B2

(12) United States Patent
Mitani et al.

(10) Patent No.: US 8,755,720 B2
(45) Date of Patent: Jun. 17, 2014

(54) POWDER SUPPLY DEVICE, DEVELOPING DEVICE, AND IMAGE FORMING APPARATUS

(75) Inventors: Rie Mitani, Hyogo (JP); Tomofumi Yoshida, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/592,893

(22) Filed: Aug. 23, 2012

(65) Prior Publication Data

US 2013/0051864 A1 Feb. 28, 2013

(30) Foreign Application Priority Data

Aug. 26, 2011 (JP) ..... 2011-184778

(51) Int. Cl.
*G03G 15/08* (2006.01)

(52) U.S. Cl.
USPC ..... 399/258

(58) Field of Classification Search
USPC ..... 399/258, 259
See application file for complete search history.

(56) References Cited

U.S. PATENT DOCUMENTS

| | | | | |
|---|---|---|---|---|
| 2001/0031414 | A1 * | 10/2001 | Yoshida et al. | 430/108.3 |
| 2002/0039502 | A1 | 4/2002 | Matsumoto et al. | |
| 2005/0169673 | A1 * | 8/2005 | Matsumoto et al. | 399/258 |
| 2010/0189470 | A1 * | 7/2010 | Yoshizawa et al. | 399/262 |

FOREIGN PATENT DOCUMENTS

| | | |
|---|---|---|
| JP | 08-171281 | 7/1996 |
| JP | 2004-189302 | 7/2004 |
| JP | 2006-113615 | 4/2006 |
| JP | 2007-058002 | 3/2007 |

OTHER PUBLICATIONS

Office Action for corresponding Chinese patent application No. 201210295654.2 dated Jan. 27, 2014.

* cited by examiner

*Primary Examiner* — Walter L Lindsay, Jr.
*Assistant Examiner* — Barnabas Fekete
(74) *Attorney, Agent, or Firm* — Harness, Dickey & Pierce, P.L.C.

(57) ABSTRACT

A powder supply device including a powder storage, a powder discharge part, and an air suction part. The powder storage stores a powder. The powder discharge part is adapted to discharge the powder from the powder storage to a powder container. The powder discharge part is communicatable with the powder storage and connectable to the powder container. The air suction part is adapted to suck an air from the powder container to generate an air current flowing from the powder storage to the powder container.

10 Claims, 12 Drawing Sheets

FIG. 9
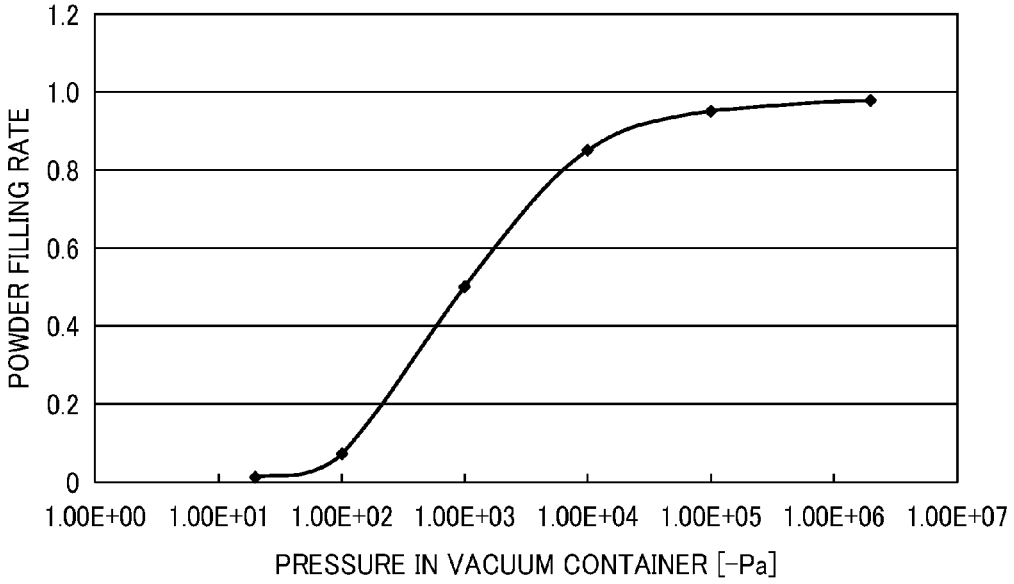
FIG. 10A
FIG. 10B
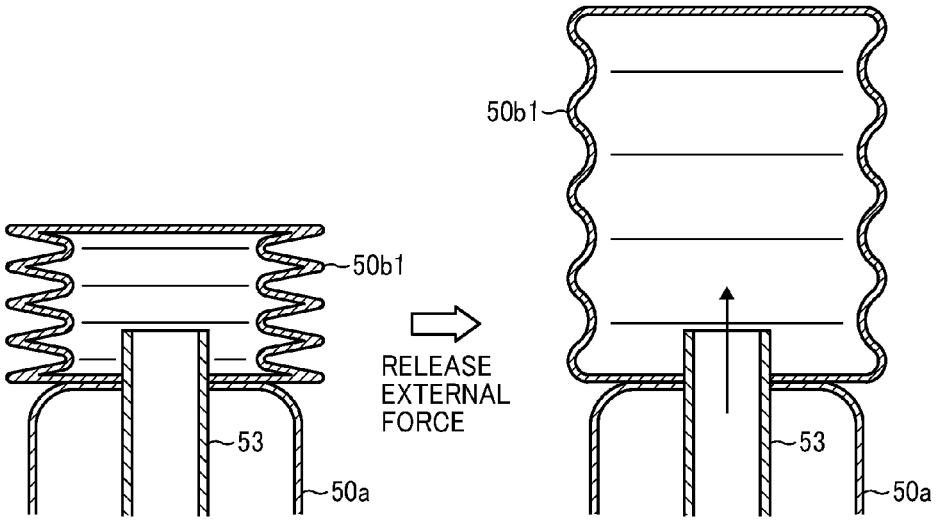

POWDER SUPPLY DEVICE, DEVELOPING DEVICE, AND IMAGE FORMING APPARATUS

CROSS-REFERENCE TO RELATED APPLICATIONS

This patent application is based on and claims priority pursuant to 35 U.S.C. §119 to Japanese Patent Application No. 2011-184778, filed on Aug. 26, 2011, in the Japanese Patent Office, the entire disclosure of which is hereby incorporated herein by reference.

BACKGROUND

1. Technical Field

The present disclosure relates to a powder supply device, a developing device, and an image forming apparatus.

2. Description of Related Art

Electrophotographic image forming apparatuses are widely used. In such image forming apparatuses, an electrostatic latent image is formed on a photoreceptor that is photosensitive, the electrostatic latent image is supplied with toner particles to be developed into a toner image, and the toner image is transferred onto a recording material. Toner particles are generally supplied from a developing device to the latent image. As the toner particles are consumed in the developing device, fresh toner particles are supplied to the developing device.

Toner particles can be supplied to the developing device by, for example, 1) directly connecting a toner supply device to a toner container of the developing device; 2) directly connecting a toner supply device to a toner hopper of the developing device; 3) replacing a toner container or a toner cartridge or imaging unit equipped with the toner container, each being detachably attached to the image forming apparatus, with a new one; or 4) directly connecting a toner supply device to a toner cartridge or imaging unit. In any of the above procedures, a detector detects residual quantity of toner particles in the developing device and notifies users that the toner particles have been almost consumed in the developing device.

In the above procedures 1), 2), and 4), the toner supply device is generally configured simple and disposable. Toner particles are dropped from the toner supply device by their own weight. Such simple and disposable toner supply devices have an advantage in terms of cost because of having a small number of replaceable parts. However, dropping toner particles by their own weight may undesirably cause clogging of the discharge opening of the toner supply device. It is likely that users give the toner supply device a shake or tap when trying to remove the clogging. However, such an action may cause unexpected detachment of the discharge opening of the toner supply device from the supply opening of the developing device, resulting in the occurrence of toner leakage and scattering from the discharge opening.

Japanese Patent Application Publication No. 08-171281 describes a toner supply device which is never detachable from the developing device once being attached to the developing device. This toner supply device requires the developing device to have multiple supply openings. This toner supply device and the developing device are vertically disposed and toner particles are dropped by their own weight, which may cause toner clogging.

The above procedure 3) is simple and easy but requires a large number of replaceable parts. To reduce the number of replaceable parts to reduce manufacturing cost, there is an attempt to provide an air pump to the image forming apparatus. The air pump circulates air within the developing device to agitate or convey toner particles. Thus, there is no need to provide toner agitating members, such as screw and agitator, which results in reduction of the number of parts and manufacturing cost. However, provision of the air pump may increase the manufacturing cost or size of the image forming apparatus.

SUMMARY

In accordance with some embodiments, a powder supply device is provided. The powder supply device includes a powder storage, a powder discharge part, and an air suction part. The powder storage stores a powder. The powder discharge part is adapted to discharge the powder from the powder storage to a powder container. The powder discharge part is communicatable with the powder storage and connectable to the powder container. The air suction part is adapted to suck an air from the powder container to generate an air current flowing from the powder storage to the powder container.

In accordance with some embodiments, a developing device is provided. The developing device includes a powder container and the above powder supply device. The powder stored in the powder storage includes toner particles.

In accordance with some embodiments, an image forming apparatus is provided. The image forming apparatus includes an image bearing member adapted to bear a latent image and the above developing device. The developing device is adapted to develop the latent image into a toner image with the toner particles.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein:

FIG. 9 is a graph showing a relation between pressure in the vacuum container and powder filling rate in the toner hopper;

FIGS. 10A and 10B are cross-sectional views of the hollow body according to another embodiment;

DETAILED DESCRIPTION

Figure 1:
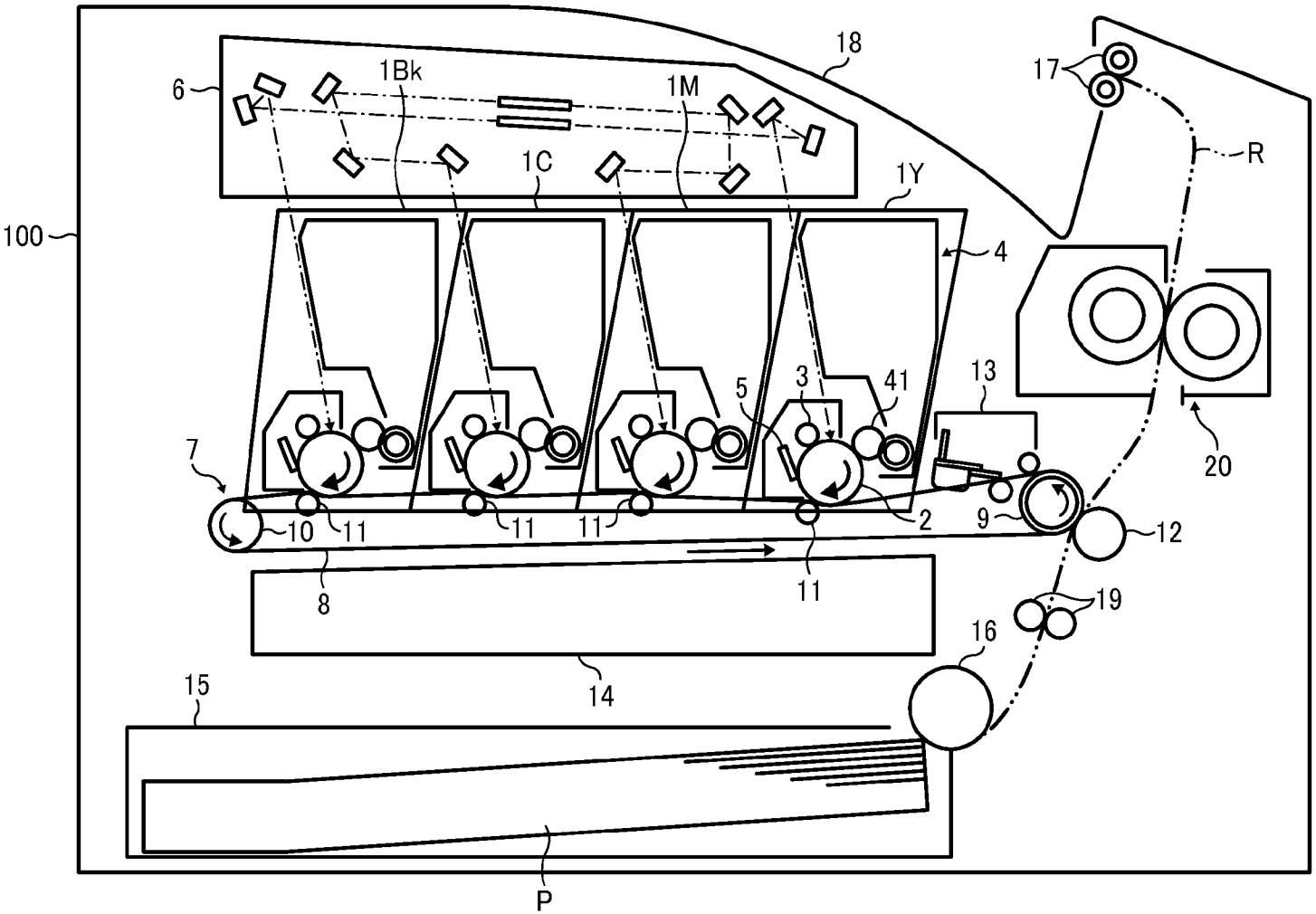
FIG. 1 is a schematic view of an image forming apparatus according to an embodiment.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

FIG. 1 is a schematic view of an image forming apparatus according to an embodiment. The image forming apparatus includes four imaging units 1Y, 1M, 1C, and 1Bk. Each of the imaging units includes a photoreceptor 2, a charging roller 3, a developing device 4, and a cleaning blade 5. According to another embodiment, each of the imaging units 1Y, 1M, 1C, and 1Bk may include the developing device 4 and at least one of the photoreceptor 2, charging roller 3, and cleaning blade 5. According to another embodiment, each of the imaging units 1Y, 1M, 1C, and 1Bk includes one of the charging roller 3, developing device 4, and cleaning blade 5; the photoreceptor 2, and a toner container.

A powder supply device according to an embodiment supplies toner particles to the developing device 4, a toner hopper 40 of the developing device 4, or a toner container of a toner cartridge or imaging unit.

The image forming apparatus illustrated in FIG. 1 is a full-color laser printer. The imaging units 1Y, 1M, 1C, and 1Bk are detachably mounted on a main body 100 of the image forming apparatus. Each of the imaging units 1Y, 1M, 1C, and 1BK has the same configuration as the others except for containing a toner of yellow, magenta, cyan, and black, respectively. The image forming apparatus illustrated in FIG. 1 employs a non-magnetic one-component contact developing method. According to another embodiment, the image forming apparatus may employ a two-component developing method.

Each of the imaging units 1Y, 1M, 1C, and 1Bk includes a photoreceptor 2, a charger equipped with a charging roller 3, a developing device 4, and a cleaner equipped with a cleaning blade 5. The photoreceptor 2 has a drum-like shape and serves as a latent image bearing member. The charging roller 3 charges a surface of the photoreceptor 2 upon application of a predetermined bias from a high-voltage power supply. The developing device 4 supplies toner particles to a latent image on the photoreceptor 2. The cleaning blade 5 cleans a surface of the photoreceptor 11. In FIG. 1, for the sake of simplicity, reference numerals for the photoreceptor 2, charging roller 3, developing device 4, and cleaning blade 5 are illustrated only around the imaging unit 1Y.

An inadiator 6 that emits light to a surface of each photoreceptor 2 is disposed above the imaging units 1Y, 1M, 1C, and 1Bk in FIG. 1. The inadiator 6 includes a light source, a polygon mirror, an f-θ lens, and a reflective mirror. The inadiator 6 is adapted to emit laser light to a surface of each photoreceptor 2 based on image information.

A transfer device 7 is disposed below the imaging units 1Y, 1M, 1C, and 1Bk in FIG. 1. The transfer device 7 includes an intermediate transfer belt 8 that is an endless belt. The intermediate transfer belt 8 is stretched taut between a driving roller 9 and a driven roller 10. The intermediate transfer belt 8 rotates in a direction indicated by an arrow in FIG. 1 as the driving roller 9 rotates counterclockwise.

Four primary transfer rollers 11 are disposed facing the respective photoreceptors 2. Each of the primary transfer rollers 11 presses against an inner peripheral surface of the intermediate transfer belt 8. Thus, the intermediate transfer belt 8 is brought into contact with the photoreceptor 2 and a primary transfer nip is formed therebetween. A place where two members meet and press against each other is a so-called nip. Each of the primary transfer rollers 11 is connected to a power source which supplies a predetermined direct current voltage (DC) and/or alternating current voltage (AC) thereto.

A secondary transfer roller 12 is disposed facing the driving roller 9. The secondary transfer roller 12 presses against an outer peripheral surface of the intermediate transfer belt 8 and a secondary transfer nip is formed therebetween. The secondary transfer roller 12 is connected to a power source which supplies a predetermined direct current voltage (DC) and/or alternating current voltage (AC) thereto.

A belt cleaner 13 that cleans the surface of the intermediate transfer belt 8 is disposed facing an outer peripheral surface of the intermediate transfer belt 8 on a right side in FIG. 1. The belt cleaner 13 is connected to a waster toner container 14 disposed below the transfer device 7 with a waste toner transport hose.

A paper feed cassette 15 that stores multiple sheets of a recording medium P (e.g., paper, OHP sheets) is disposed at a lower part of the main body 100. The paper feed cassette 15 is equipped with a paper feed roller 16 that feeds the recording medium P sheet by sheet. A pair of discharge rollers 17 that ejects sheets of the recording medium P and a paper ejection tray 18 on which the ejected sheets are to be stacked are disposed at an upper part of the main body 100.

The main body 100 has a conveyance path R for conveying sheets of the recording medium P from the paper feed cassette 15 to the ejection tray 18 through the secondary transfer nip. A pair of registration rollers 19 is disposed on the conveyance path R upstream from the secondary transfer roller 12 relative to the direction of conveyance of the recording medium P. A fixing device 20 is disposed on the conveyance path R downstream from the secondary transfer roller 12 relative to the direction of conveyance of the recording medium P.

When an imaging operation is initiated, first, the photoreceptors 2 in each imaging units 1Y, 1M, 1C, and 1Bk are driven to rotate counterclockwise in FIG. 1. A surface of each photoreceptor 2 is then uniformly charged to a predetermined potential by the charging roller 3 that is rotating by rotation of the photoreceptor 2. The charged surface of the photoreceptor 2 is irradiated with laser light emitted from the irradiator 6 based on image information read by a reading device. Thus, an electrostatic latent image is formed on the photoreceptor 2. Each of the photoreceptors 2 is exposed to the laser light based on single-color image information of yellow, magenta, cyan, or black. In the developing device 4, a developing roller 41 is biased so as to have a potential having the same polarity to toner and exceeding that of the latent image portion in absolute value. Thus, an electric field is generated between the photoreceptor 2 and the developing roller 41. Owing to a force from the electric field, toner particles carried by the developing roller 41 are supplied to the electrostatic latent image on the photoreceptor 2. The electrostatic latent image is developed into a toner image.

The driving roller 9 is driven to rotate to make the intermediate transfer belt 8 rotate in the direction indicated by an arrow in FIG. 3. Each of the primary transfer rollers 11 is supplied with a constant-voltage-controlled or constant-current-controlled voltage having the opposite polarity to toner so that a transfer electric field is formed in the primary transfer nip defined between the primary transfer roller 11 and the photoreceptor 2. Toner images formed on the photoreceptors 2 are sequentially transferred onto the intermediate transfer belt 8 and superimposed on one another in the primary transfer nips by action of the transfer electric field. Thus, a full-color composite toner image is formed on a surface of the intermediate transfer belt 8. Residual toner particles remaining on the photoreceptor 2 without being transferred onto the intermediate transfer belt 8 are removed by the cleaning blade 5.

On the other hand, when the imaging operation is initiated, the paper feed roller 16 starts rotating to feed the recording medium P from the paper feed cassette 15. The registration rollers 19 feed the recording medium P to the secondary transfer nip defined between the secondary transfer roller 12 and the intermediate transfer belt 8 in synchronization with an entry of the full-color composite toner image into the secondary transfer nip. The secondary transfer roller 12 is supplied with a transfer voltage having the opposite polarity to the full-color composite toner image on the intermediate transfer belt 8 so that a transfer electric field is formed in the secondary transfer nip. The full-color composite toner image is transferred from the intermediate transfer belt 8 onto the recording medium P in the secondary transfer nip by action of the transfer electric field. The full-color composite toner image is then fixed on the recording medium P in the fixing device 20. The recording medium P having the fixed full-color composite toner image is ejected on the ejection tray 18 by rotation of the pair of discharge rollers 17.

In the above-described embodiment, all the four imaging units 1Y, 1M, 1C, and 1Bk are brought into operation to form full-color images. In some embodiments, only two or three out of four imaging units 1Y, 1M, 1C, and 1Bk may be brought into operation to form two-color or three-color images.

Figure 2:
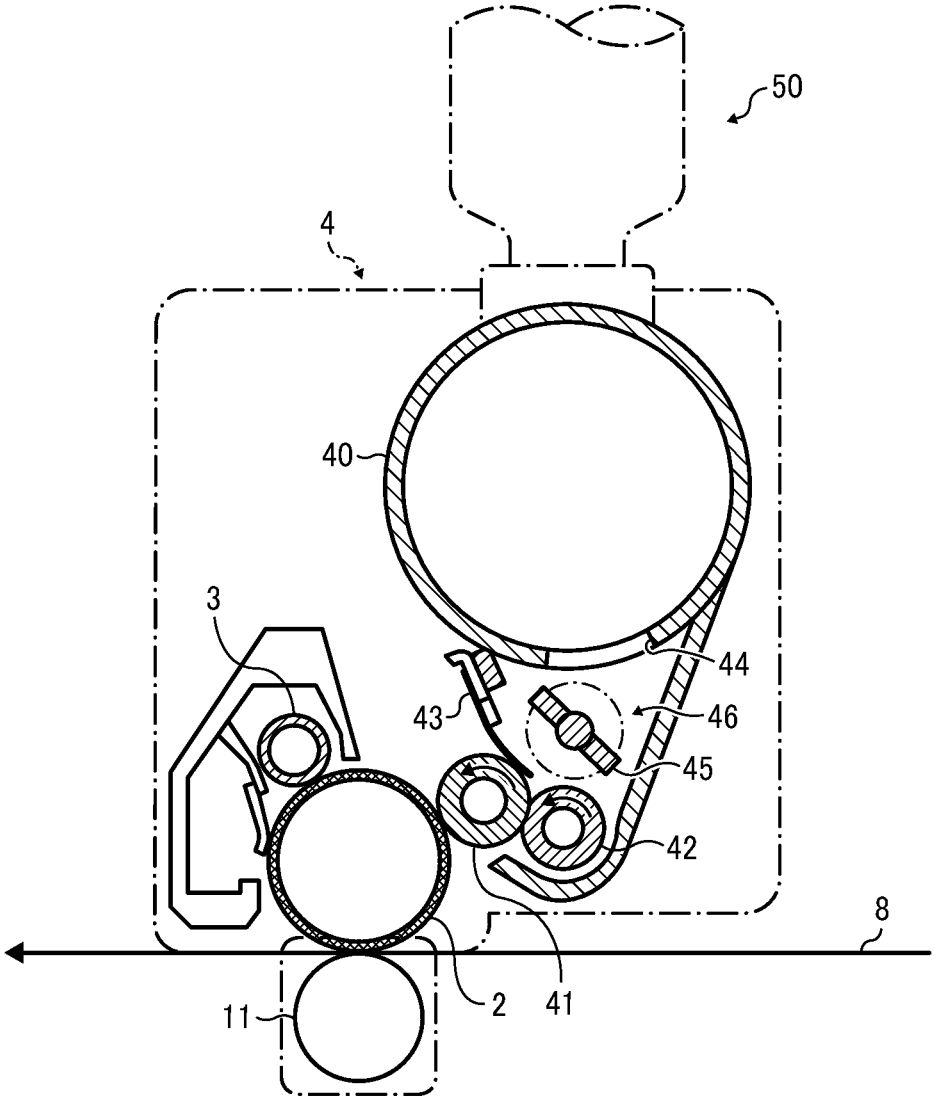
FIG. 2 is a schematic cross-sectional view of a developing device according to an embodiment.

FIG. 2 is a schematic cross-sectional view of the developing device 4. The developing device 4 includes a toner hopper 40 for containing toner particles, a developing roller 41 that bears toner particles, a supply roller 42 that supplies toner particles to the developing roller 41, and a regulator 43 that regulates the amount of toner particles carried on the developing roller 41. The toner hopper 40 is communicated with a toner supply chamber 46 through a communication opening 44. The developing roller 41, regulator 43, and developer conveying member 45 are provided to the toner supply chamber 46.

An upper part of the toner hopper 40 is detachably connectable to a powder supply device 50 according to an embodiment. Toner particles are supplied to the toner hopper 40 when a toner residual quantity detector detects a signal that the toner residual quantity in the toner hopper 40 falls below a predetermined value.

The developing roller 41 comprises a metallic cored bar having an outer coating of a conductive rubber. In some embodiments, the cored bar has an outer diameter of ϕ6, and the conductive rubber has an outer diameter of ϕ12 and a rubber hardness Hs of 75. In some embodiments, the conductive rubber has a volume resistance of about 10^5 to 10^7Ω. Specific materials usable as the conductive rubber include, but are not limited to, urethane rubbers and silicone rubbers which are conductive. The developing roller 41 rotates counterclockwise in FIG. 2 while carrying toner particles on its surface. The toner particles are conveyed to a position where the regulator 43 faces the photoreceptor 2.

In some embodiments, the supply roller 42 comprises a sponge roller. The sponge roller may comprise, for example, a metallic cored bar having an outer coating of a foamed polyurethane mixed with carbon to be semiconductive. The supply roller 42 is disposed in contact with the developing roller 41. The supply roller 42 and developing roller 41 form a nip having a width of about 1 to 3 mm therebetween. The supply roller 42 rotates so as to face in the direction of rotation of the developing roller 41 (i.e., counterclockwise in FIG. 2) so that toner particles are effectively supplied from the toner hopper 40 to a surface of the developing roller 41.

In some embodiments, the regulator 43 comprises a metallic plate, such as an SUS plate, having a thickness of about 0.1 mm. A leading edge of the regulator 43 is in contact with a surface of the developing roller 41. Toner particles are supplied onto the developing roller 41 by the supply roller 42 and pass through the nip formed between the developing roller 41 and regulator 43. Thus, the toner particles are formed into a thin layer while being frictionally charged.

The powder supply device 50 according to an embodiment is connectable to the toner hopper 40 of the developing device 4 as illustrated in FIG. 2. According to another embodiment, the powder supply device 50 is connectable to a toner cartridge or a toner container in a process cartridge.

Figure 3A:
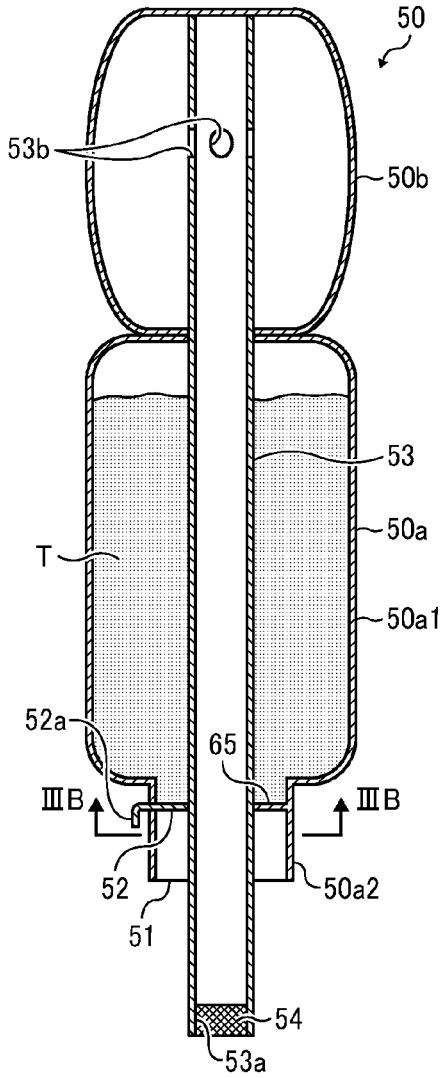
FIG. 3A is a vertical cross-sectional view of a powder supply device having a hollow body according to an embodiment.

FIG. 3A is a vertical cross-sectional view of the powder supply device 50. The powder supply device 50 includes a cylindrical powder storage 50*a* and a barrel-shaped hollow body 50*b*. The powder storage 50*a* and hollow body 50*b* have substantially the same outer diameter. A main body 50*a*1 of the powder storage 50*a* can be carried by a hand of users. When the powder supply device 50 is in operation, the powder supply device 50 is placed vertically with the hollow body 50*b* up, as illustrated in FIG. 3A. Alternatively, the powder supply device 50 may be placed slanted or horizontally. According to an embodiment, the main body 50*a*1 of the powder storage 50*a* that stores toner T is comprised of a hard casing, such as a resin cylinder. According to another embodiment, the main body 50*a*1 is comprised of a plastic pouch, such as a laminate film pouch. A part or whole of the main body 50*a*1 may be transparent or translucent to allow users to visually determine the amount of toner T contained and to reliably supply toner particles thereto. In a case in which the main body 50*a*1 is comprised of a hard casing, an upper part of the hard casing may be equipped with an air-permeable filter or check valve that introduces outer air, if needed.

The powder storage 50*a* has a small-diameter cylindrical part 50*a*2 at its lower part. The diameter of the small-diameter cylindrical part 50*a*2 is smaller than that of the main body 50*a*1. The small-diameter cylindrical part 50*a*2 has a discharge part 51 at its lower or leading end. The small-diameter cylindrical part 50*a*2 is attachable to a supply opening 47 disposed on an upper wall of a toner hopper 40*a*, as illustrated in FIG. 4. The outer peripheral surface of the small-diameter cylindrical part 50*a*2 may be equipped with a material which improves sealing performance, such as MOLTOPRENE, to prevent the toner T from leaking or scattering from the supply opening 47.

Figure 3B:
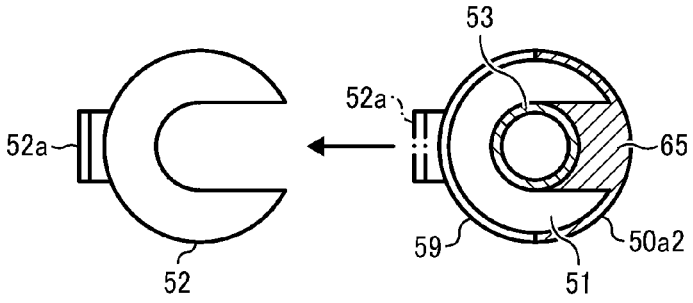
FIG. 3B is a cross-sectional view taken along a line IIIB-IIIB in FIG. 3A.

FIG. 3B is a cross-sectional view taken along a line IIIB-IIIB in FIG. 3A. A seal plate 52 having a tab 52*a* is removably provided on a base end of the small-diameter cylindrical part 50*a*2. The seal plate 52 closes the discharge part 51 so that the toner T stored in the powder storage 50*a* cannot be discharged from the discharge part 51 when the powder supply device 50 is not in operation. According to an embodiment, the seal plate 52 is comprised of a thin plastic sheet, such as a PET sheet. The seal plate 52 is C-shaped so as to avoid interference from a pipe member 53 when inserted into a slit 59, formed in a transverse direction relative to the small-diameter cylindrical part 50*a*2, to close the discharge part 51. A lower end part of the pipe member 53 is connectable to a support part 65 contiguous to an inner peripheral surface of the small-diameter cylindrical part 50*a*2.

Figure 4A:
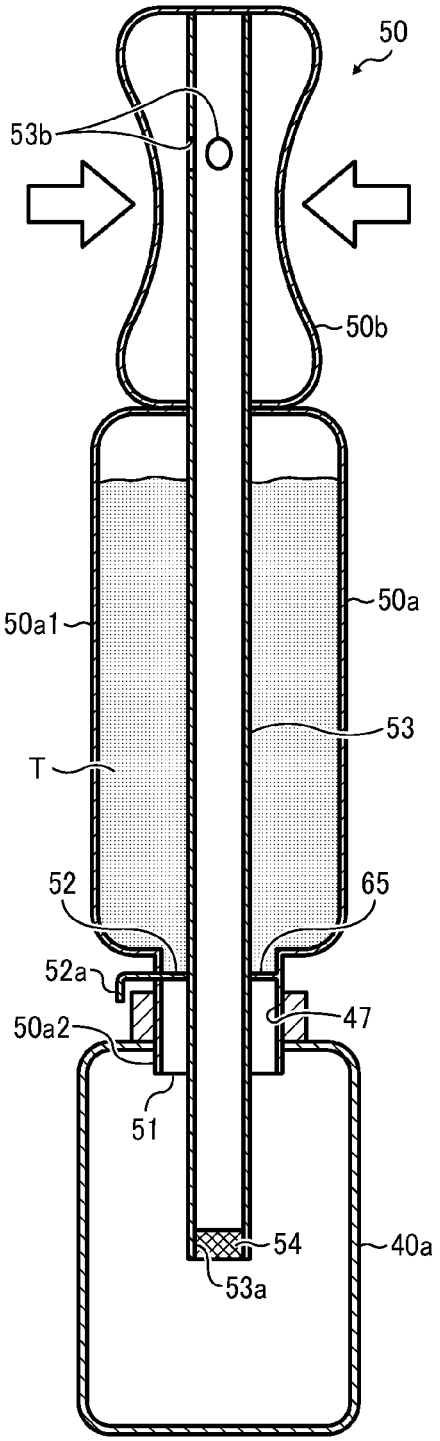
FIG. 4A is a schematic cross-sectional view of the powder supply device having a hollow body when a toner supplying operation is not occurring.
Figure 4B:
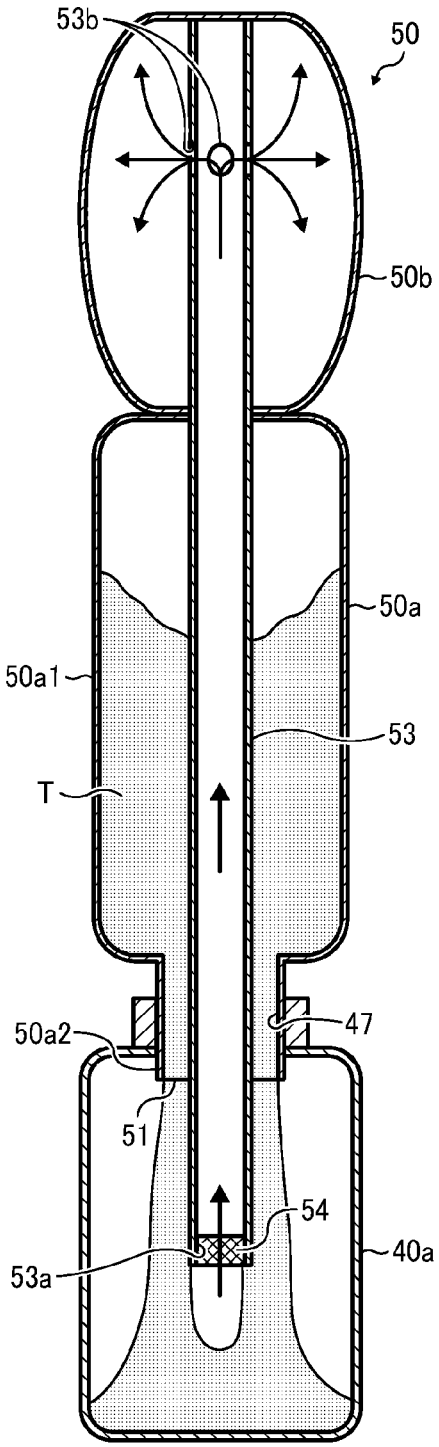
FIG. 4B is a schematic cross-sectional view of the powder supply device having a hollow body when a toner supplying operation is occurring.

According to an embodiment, the hollow body 50*b* is comprised of a soft and impact-resilient material, such as natural or synthetic rubber. The hollow body 50*b* has a shape like a vertical barrel and is slightly shorter than the powder storage 50*a*. The hollow body 50*b* is integrally attachable to an upper end of the powder storage 50*a*. FIG. 4A is a schematic cross-sectional view of the powder supply device 50 when a toner supplying operation is not occurring. FIG. 4B is a schematic cross-sectional view of the powder supply device 50 when a toner supplying operation is occurring. The hollow body 50*b* elastically contracts when the outer periphery of the hollow body 50*b* is applied with a pressure, as illustrated in FIG. 4A, and returns to its original shape due to elastic restoring force when the pressure is released, as illustrated in FIG. 4B. The shape of the hollow body 50*b* is not limited to a vertical barrel. The hollow body 50*b* may take any shape so long as the hollow body 50*b* is elastically restorable.

The pipe member 53 is vertically penetrated the center of the powder storage 50*a* and hollow body 50*b*, as illustrated in FIG. 3A. An upper end of the pipe member 53 is fixed to an upper wall of the hollow body 50*b*. A predetermined length of lower end of the pipe member 53 is protruded downward from the discharge part 51 of the small-diameter cylindrical part 50*a*2. The protruded end defines a suction opening 53*a*. A filter 54 having a predetermined thickness is fit into the suction opening 53*a*. The filter 54 allows passage of air but avoids passage of toner. The filter 54 may be positioned on any portion on a suction path within the pipe member 53. According to another embodiment, another filter may be provided at a middle-height position of the pipe member 53 in place of the filter 54 fit into the suction opening 53*a*. According to another embodiment, in addition to the filter 54 fit into the suction opening 53*a*, a second filter may be provided at a middle-height position or upper end part of the pipe member 53.

The pipe member 53 has multiple holes 53*b* on its peripheral wall of its upper end part which is stretched within the hollow body 50*b*. Air sucked from the suction opening 53*a* is introduced into the hollow body 50*b* through the holes 53*b*. When the powder supply device 50 is not in operation, the hollow body 50*b* is kept in a contracted state, as illustrated in FIG. 4A, by binding the outer periphery of the hollow body 50*b* with a piece of string or winding a length of tape around the outer periphery of the hollow body 50*b*. When the powder supply device 50 is in operation, i.e., when toner particles are being supplied from the powder supply device 50, the hollow body 50*b* is elastically expanded or restored upon removal of the string or tape.

When the powder supply device 50 is brought into operation, the small-diameter cylindrical part 50*a*2 is attached to the supply opening 47 of the toner hopper 40*a*, as illustrated in FIG. 4A, followed by drawing out the seal plate 52 by pulling the tab 52*a* with a finger or nail of users. Since withdrawal of the seal plate 52 does not always let the toner T smoothly fall down from the powder storage 50*a*, the string or tape wound around the hollow body 50*b* is removed as well. Thus, the hollow body 50*b* rapidly returns to its original shape due to elastic restoring force, as illustrated in FIG. 4B, while increasing its inner volume. Due to this rapid expansion of the hollow body 50*b*, the air in the toner hopper 40*a* is rapidly sucked from the suction opening 53*a* into the hollow body 50*b*.

As a result, the pressure in the toner hopper 40*a* gets lower than that in the powder storage 50*a*. This pressure difference generates an air current flowing from the powder storage 50*a* to the toner hopper 40*a*. The toner T in the powder storage 50*a* is carried by the air current and discharged from the discharge part 51 to the toner hopper 40*a*.Since the toner T is forcibly carried to the toner hopper 40*a* by the air current flowing from the powder storage 50*a* to the toner hopper 40*a*, the toner T is reliably supplied to the toner hopper 40*a* even when the powder supply device 50 is placed slanted or horizontally.

Residual toner particles remaining in the toner hopper 40*a*, even in a small amount, may be undesirably sucked from the suction opening 53*a* and clog the filter 54. The clogged filter 54 degrades degassing efficiency as well as powder filling rate of the toner hopper 40*a*. In a case in which the hollow body 50*b* is expanded prior to removal of the seal plate 52 for the purpose of increasing a pressure difference between the toner hopper 40*a* and the powder storage 50*a*, the air in the toner hopper 40*a* is sucked from the suction opening 53*a* very rapidly upon removal of the seal plate 52. In such a case, it is more likely that the filter 54 is clogged with toner particles.

Clogging toner particles can be removed from the filter 54 by compressing the hollow body 50*b* by hand to increase the inner pressure of the hollow body 50*b* and reversely flow the air in the hollow body 50*b* to the toner hopper 40*a* through the pipe member 53. Thus, clogging toner particles are blown into the toner hopper 40*a*. Upon removal of the hand from the compressed hollow body 50*b*, the hollow body 50*b* expands again and the toner T stored in the powder storage 50*a* is discharged from the discharge part 51 to the toner hopper 40*a*.

Figure 5A:
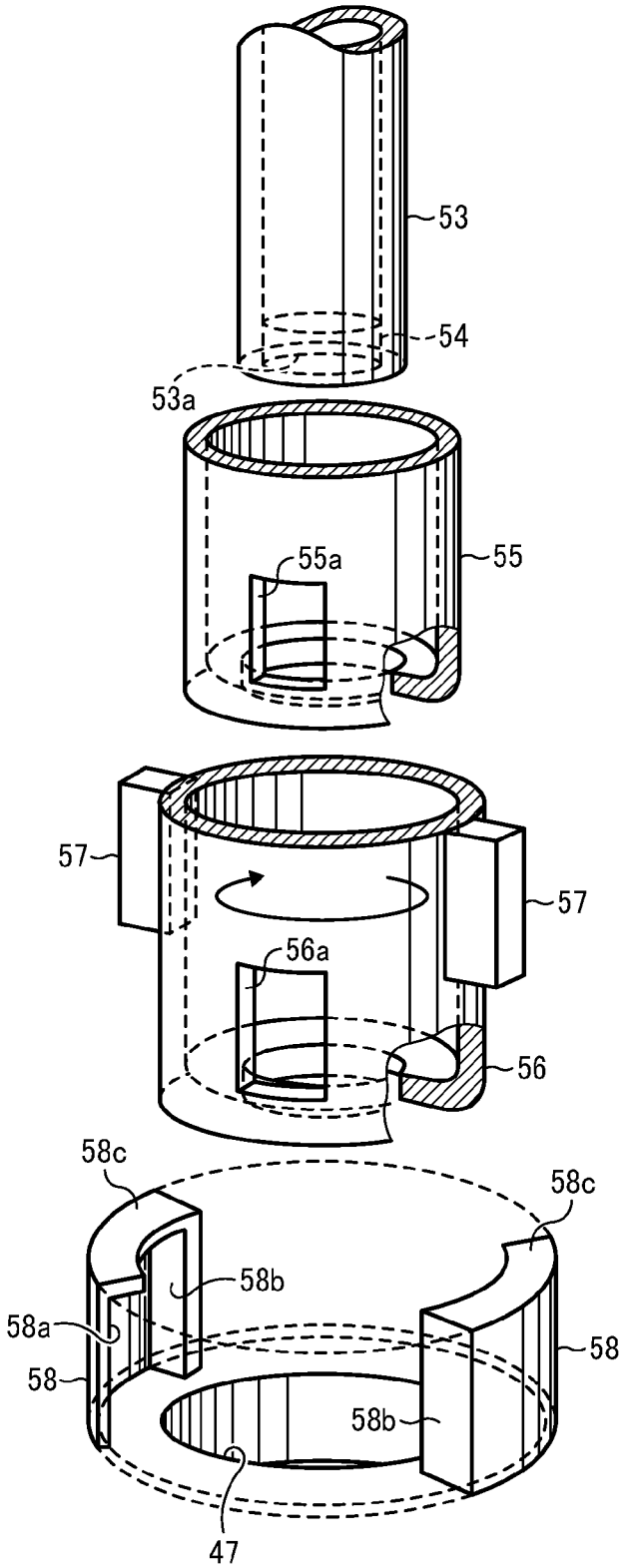
FIGS. 5A and 5B are perspective and cross-sectional views, respectively, of a rotary opening-closing mechanism according to an embodiment.
Figure 5B:
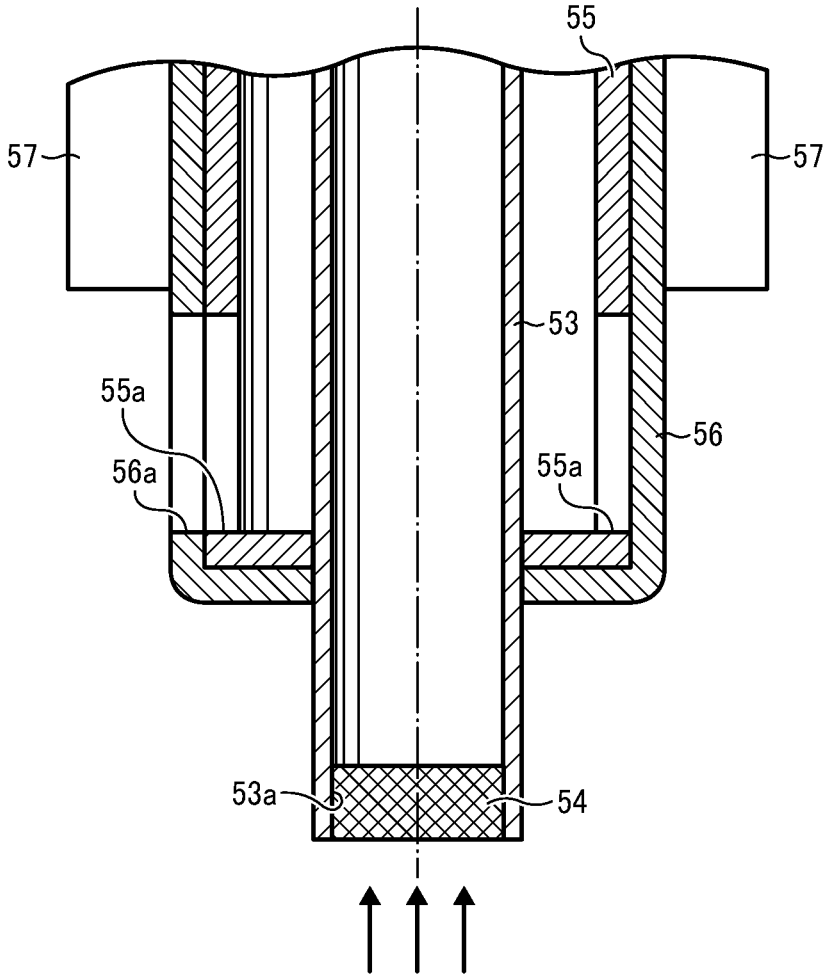

In the above-described embodiment, the discharge part 51 is closable with the seal plate 52. According to another embodiment, the discharge part 51 is openable and closable by rotation of the powder supply device 50 about the center axis of the toner hopper 40*a*. FIGS. 5A and 5B are perspective and cross-sectional views, respectively, of a rotary opening-closing mechanism according to an embodiment. In this mechanism, the pipe member 53 and a powder discharge cylinder 55 that is extended downward from the small-diameter cylindrical part 50*a*2 of the powder storage 50*a* are concentrically arranged with forming a gap therebetween. The outer periphery of the powder discharge cylinder 55 is rotatably fit into a cylindrical insertion part 56 having a pair of tabs 57 on the outer periphery.

Each of the powder discharge cylinder 55 and insertion part 56 has at least one opening 55*a* and 56*a*, respectively, on its peripheral wall. Depending on the relative position of the insertion part 56 to the powder discharge cylinder 55, as illustrated in the left side of FIG. 5B, the openings 55*a* and 56*b* can be aligned so that the inner side of the powder discharge cylinder 55 is communicated with the outer side of the insertion part 56. Alternatively, as illustrated in the right side of FIG. 5B, the openings 55*a* and 56*a* can be out of alignment in the circumferential direction so that the outer side of the opening 55*a* of the powder discharge cylinder 55 is closed with the insertion part 56. When the powder supply device 50 is not in operation, the openings 55*a* and 56*a* are kept out of alignment in the circumferential direction (i.e., in a "closed state") by action of a spring that is provided between the insertion part 56 and the powder discharge cylinder 55.

On the other hand, a pair of projections 58 facing each other in a radial direction is vertically provided outside the supply opening 47 of the toner hopper 40*a*. The projections 58 form arc-like walls around the supply opening 47. Each of the projections 58 has an opening 58*a* on its one circumferential end, a first wall 58*b* on the other circumferential end, and a second wall 58*c* stretched inward on an upper part. The opening 58*a* horizontally receives the tab 57 of the insertion part 56 and the tab 57 hits against the first wall 58*b*.

The insertion part 56 of the powder supply device 50 is fit into the supply opening 47 of the toner hopper 40*a*. The powder supply device 50 is then rotated about 90° in a direction indicated by an arrow in FIG. 5A so that the tabs 57 of the insertion part 56 are received by the projections 58 and hit against the first walls 58*b*. Thus, the insertion part 56 is restricted from further rotation in a direction indicated by the arrow. The powder supply device 50 is further rotated in a direction indicated by the arrow against the spring tension with the insertion part 56 being restricted from rotation. As a result, the powder discharge cylinder 55 is rotated relative to the insertion part 56 and the openings 55*a* and 56*a* are aligned. Thus, the toner T can be discharged from the powder storage 50*a* to the toner hopper 40*a* through the aligned openings 55*a* and 56*a*. At this time (i.e., in an "opened state"), the tabs 57 are restricted from upward movement by the second walls 58*c* of the projections 58. Therefore, the powder supply device 50 is not unexpectedly detached from the toner hopper 40*a*.

To detach the powder supply device 50 from the toner hopper 40*a* after termination of the toner supplying operation, the powder supply device 50 is rotated in the opposite direction to the arrow in FIG. 5A. As a result, the openings 55*a* and 56*a* get out of alignment in the circumferential direction (restored to the "closed state") due to the spring tension and the tabs 57 get out of the projections 58 from the openings 58*a*. Thus, the powder supply device 50 can be drawn upward from the toner hopper 40*a*. In summary, the powder supply device 50 supplies toner only when the main body 50*a* is kept rotated for a predetermined angle by user's hand. When the hand is released, the openings 55*a* and 56*a* get automatically out of alignment in the circumferential direction due to the spring tension, which prevents the occurrence of unexpected toner scattering.

Figure 6A:
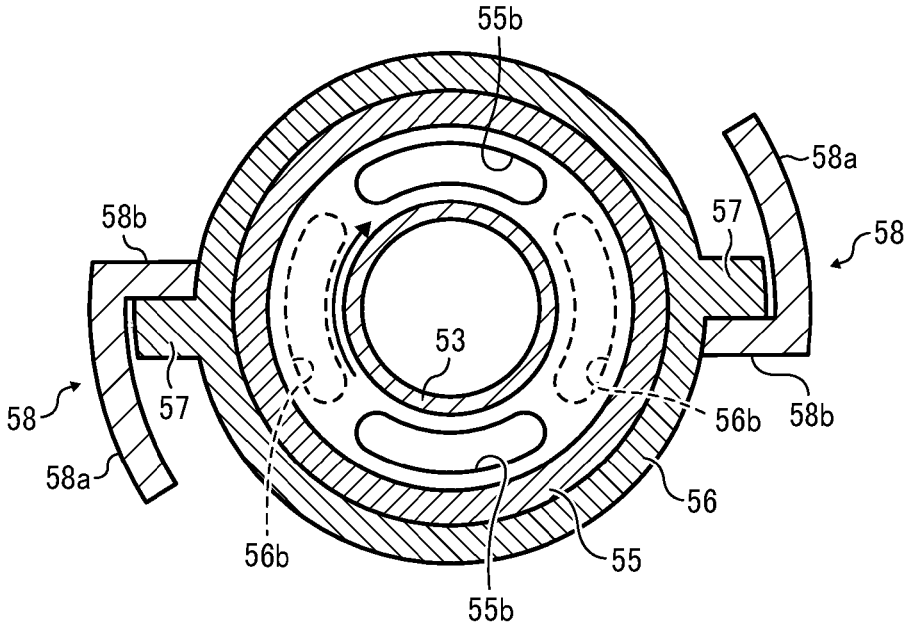
FIGS. 6A and 6B are lateral cross-sectional views of a rotary opening-closing mechanism according to another embodiment.
Figure 6B:
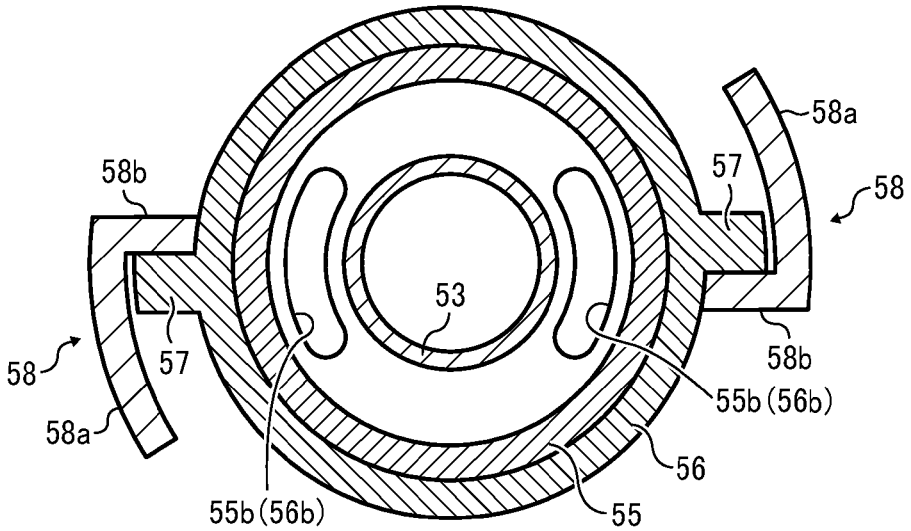

In the embodiment illustrated in FIGS. 5A and 5B, the powder discharge cylinder 55 and insertion part 56 have the openings 55*a* and 56*a*, respectively, on their peripheral walls. According to another embodiment, the powder discharge cylinder 55 and insertion part 56 have at least one opening 55*b* and 56*b*, respectively, on bottom walls thereof. FIGS. 6A and 6B are lateral cross-sectional views of a rotary opening-closing mechanism according to another embodiment. In this embodiment, a pair of arc-like openings 55*b* facing each other in a radial direction and another pair of arc-like openings 56*b* facing each other in a radial direction are provided around the pipe member 53. Similar to the above-described embodiment, when the powder discharge cylinder 55 is rotated clockwise in FIG. 6A while the tabs 57 of the insertion part 56 are restricted from movement by the first walls 58*b* of the projections 58, the openings 55*b* and 56*b* get aligned. The toner T can be discharged from the aligned openings 55*b* and 56*b*. In order to increase the toner discharging area, the powder discharge cylinder 55 may have both the openings 55*a* and 55*b* on its peripheral and bottom walls, respectively, and the insertion part 56 may have both the openings 56*a* and 56*b* on its peripheral and bottom walls, respectively.

Figure 7:
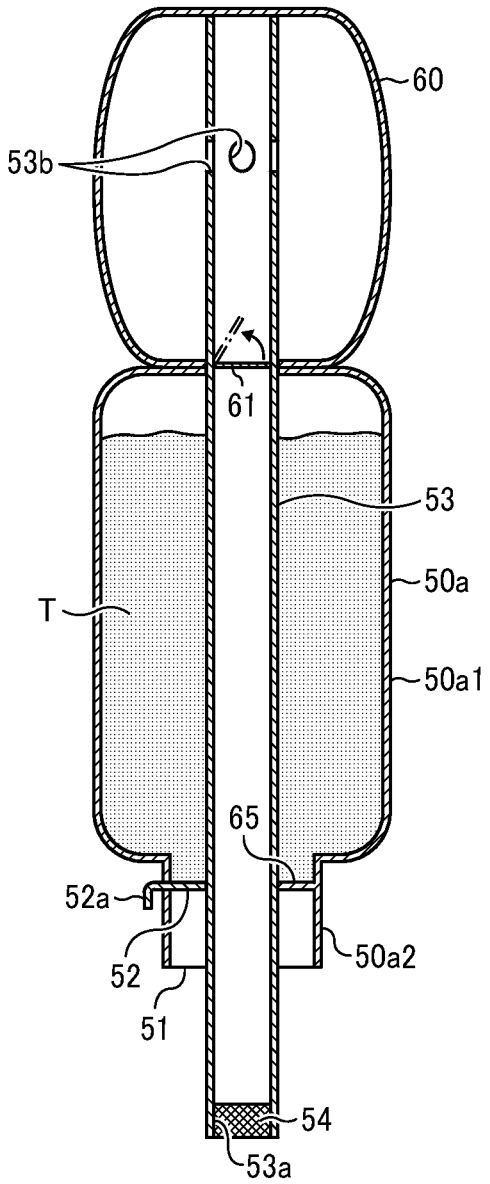
FIG. 7 is a vertical cross-sectional view of a powder supply device having a vacuum container according to another embodiment.

FIG. 7 is a vertical cross-sectional view of the powder supply device 50 according to another embodiment. In this embodiment, a vacuum container 60 is disposed on an upper end of the powder storage 50*a* in place of the hollow body 50*b*. The vacuum container 60 is not limited in size. The vacuum container 60 may have a similar size to the hollow body 50*b* or may be larger or smaller than the hollow body 50*b*. The vacuum container 60 may be comprised of a resin, rubber material, or metal, for example. The vacuumed hollow body 50*b* may be used as the vacuum container 60. In this case, the hollow body 50*b* provides suction action by both self-expansion and vacuuming.

Figure 8A:
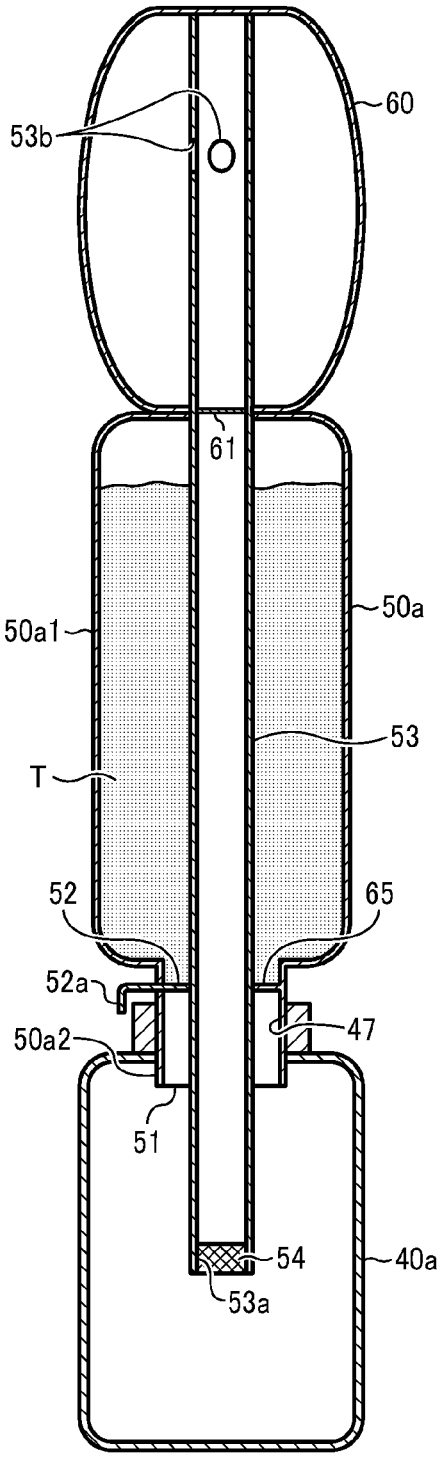
FIG. 8A is a schematic cross-sectional view of the powder supply device having a vacuum container when a toner supplying operation is not occurring.
Figure 8B:
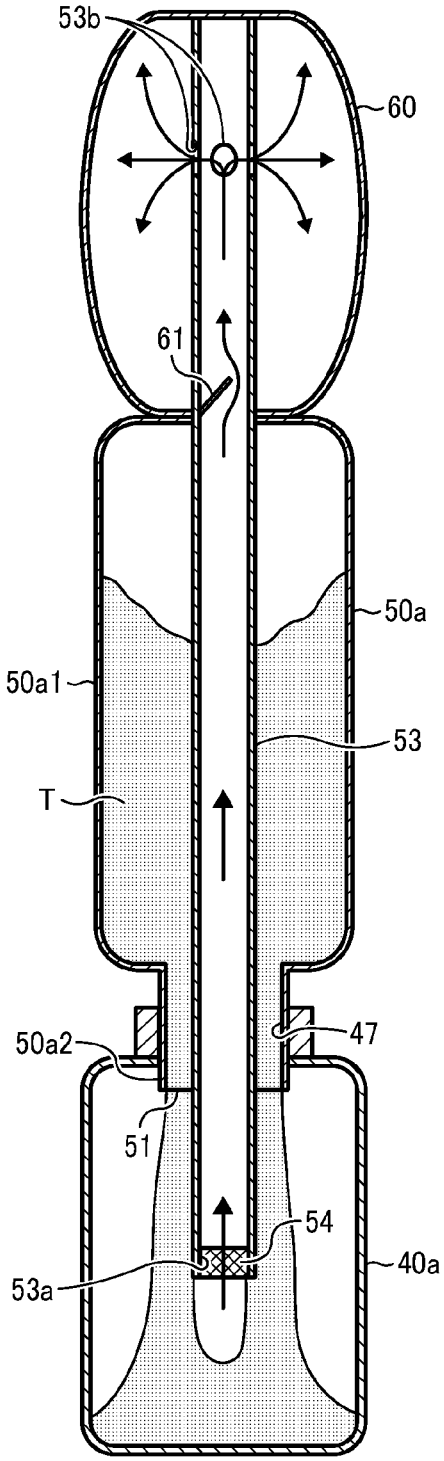
FIG. 8B is a schematic cross-sectional view of the powder supply device having the vacuum container when a toner supplying operation is occurring.

FIG. 8A is a schematic cross-sectional view of the powder supply device 50 having the vacuum container 60 when a toner supplying operation is not occurring. FIG. 8B is a schematic cross-sectional view of the powder supply device 50 having the vacuum container 60 when a toner supplying operation is occurring. As illustrated in FIGS. 8A and 8B, a valve 61, serving as a seal member, is provided within the pipe member 53. The valve 61 is openable and closable by a valve opening-closing mechanism. The valve 61 may be comprised of a plastic material, such as PET, and one end thereof is fixed to an inner surface of the pipe member 53. The valve 61 is configured to open only upward as illustrated in FIG. 8B. When the powder supply device 50 is not in operation, the valve 61 is closed with an insertion pin or a wind-up fixture. The valve 61 can be opened by releasing the pin or fixture. When the valve 61 is opened, a strong air current flowing from the powder storage 50*a* to the toner hopper 40*a* is generated due to negative pressure in the vacuum container 60. Thus, the vacuum container 60 provides a greater toner supply quantity than the hollow body 50*b*.

Alternatively, the valve 61 may be openable and closable by another opening-closing mechanism employing the mechanism of relative rotation between the powder discharge cylinder 55 and the insertion part 56 as illustrated in FIG. 5A. In this case, the valve 61 is opened in conjunction with an attachment action of the powder supply device 50 to the toner hopper 40*a*, which provides easier toner supplying procedure for users. When the powder supply device 50 is rotated in the opposite direction, not only the toner discharging parts (i.e., the openings 55*a*, 55*b*, 56*a*, and 56*b*) but also the vacuum suction path (i.e., the valve 61) are closed. Thus, the toner supplying operation is stopped and toner is not wasted.

FIG. 9 is a graph showing a relation between pressure in the vacuum container 60 and powder filling rate in the toner hopper 40*a*. The lower the pressure in the vacuum container 60, the higher the powder filling rate in the toner hopper 40*a*. This graph is compiled from experiments using toner particles having an average particle diameter of 5 μm and a circularity of 0.98 or more and including a small-diameter external additive in an amount of 1.5% or more. The small-diameter external additive comprises inorganic fine particles having a primary particle diameter of 7 to 30 nm. In the above case, the toner particles include 1.5 parts by weight or more of the small-diameter external additive based on 100 parts by weight of mother toner particles.

The powder filling rate is determined by dividing an actual filling quantity with a maximum filling quantity. The powder filling rate becomes 1.0 at maximum. It it possible to determine the pressure in the vacuum container 60 in accordance with a required powder filling rate with reference to this graph. The powder supply device 50 according to an embodiment is applicable to any type of toner, such as irregular-shaped or spherical toner which may include silicone-oil-containing silica as an external additive.

FIGS. 10A and 10B are cross-sectional views of the hollow body 50*b* according to another embodiment. A hollow body 50*b*1 illustrated in FIGS. 10A and 10B has a shape like an accordion. According to an embodiment, the hollow body 50*b*1 is comprised of a soft and impact-resilient material, such as natural or synthetic rubber. The hollow body 50*b* is a vertical cylinder having an accordion-like peripheral wall. The hollow body 50*b*1 is elastically stretchable in a vertical direction. When the powder supply device 50 is not in operation, the hollow body 50*b*1 is kept vertically compressed by a restriction member as illustrated in FIG. 10A. When the restriction member is released, the hollow body 50*b*1 stretches upward by self-restoring force. An upper end of the pipe member 53 is opened within the hollow body 50*b*1 at a low position so as not to disturb expansion and contraction of the hollow body 50*b*1.

Figure 11A:
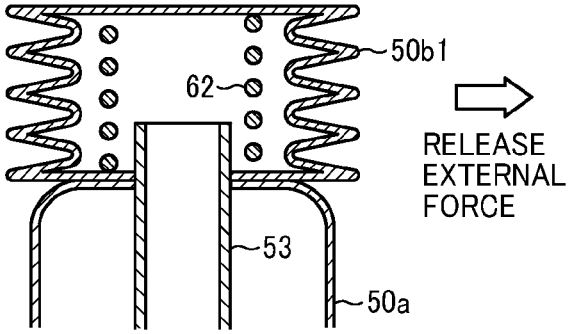
FIGS. 11A and 11B are cross-sectional views of the hollow body according to another embodiment.
Figure 11B:
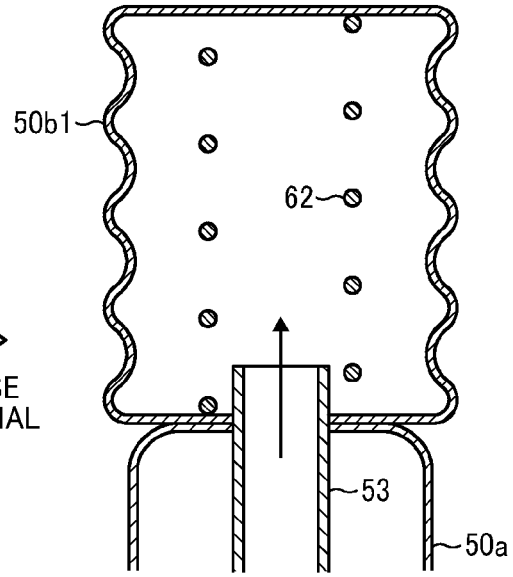

FIGS. 11A and 11B are cross-sectional views of the hollow body 50*b* according to another embodiment. In this embodiment, a compression spring 62 is provided within the accordion-like hollow body 50*b*1. The compression spring 62 generates a sufficient suction force even when elastic restoring force of the hollow body 50*b*1 is insufficient. Powder supply ability can be more improved when the tension of the compression spring 62 is increased or more than one compression springs 62 are provided. The number of the hollow body 50*b* or 50*b*1 or the vacuum container 60 is not limited to one. When the number of such members is one or more, each of the members may be sequentially brought into operation or all the members may be brought into operation at once.

Figure 12A:
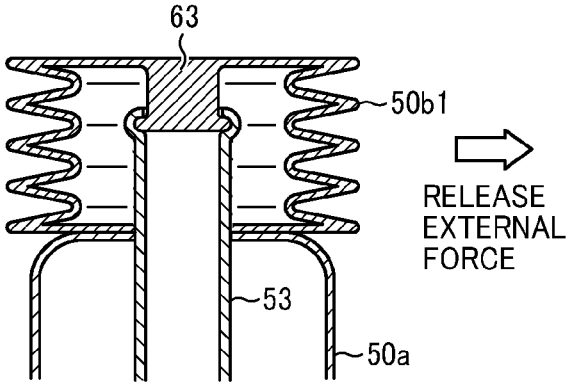
FIGS. 12A and 12B are cross-sectional views of the hollow body according to another embodiment.
Figure 12B:
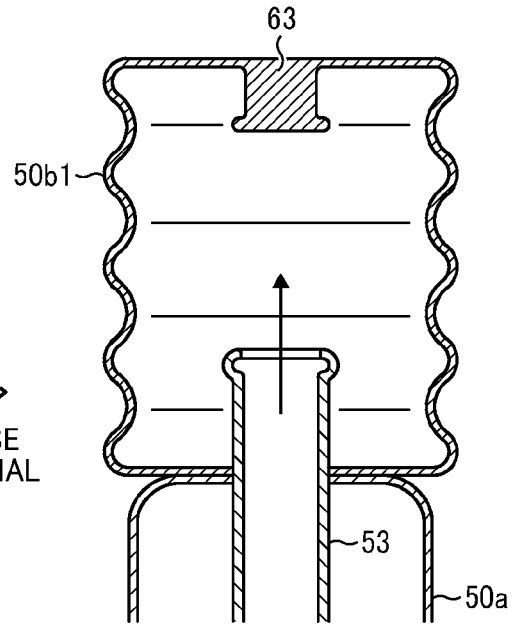

FIGS. 12A and 12B are cross-sectional views of the hollow body 50*b* according to another embodiment. In this embodiment, a plug 63 serving as a restriction member is integrally provided to an upper inner surface of the accordion-like hollow body 50*b*1. When the plug 63 is snapfastened onto an upper-end opening of the pipe member 53, the hollow body 50*b*1 is kept in a contracted state. When the plug 63 is released from the upper-end opening of the pipe member 53 by an external force, the hollow body 50*b*1 is allowed to elastically self-expand upward.

Figure 13A:
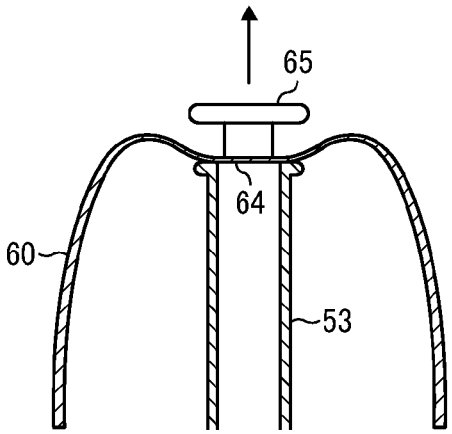
FIGS. 13A and 13B are cross-sectional views of the vacuum container according to another embodiment.
Figure 13B:
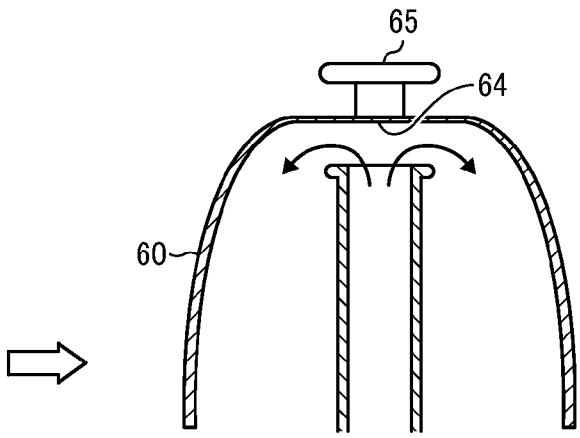

FIGS. 13A and 13B are cross-sectional views of the vacuum container 60 according to another embodiment. In this embodiment, the vacuum container 60 has a diaphragm sealing part 64 that is relatively thin, serving as a valve, on an inner surface of an upper wall. By hermetically sealing the upper-end opening of the pipe member 53 with the sealing part 64 at atmospheric pressure, the vacuum container 60 is kept in a vacuumed state. By drawing up a handle 65 of the sealing part 64 against the atmospheric pressure, the sealing part 64 is released from the upper-end opening of the pipe member 53 and the vacuum container 60 generates suction force.

Additional modifications and variations in accordance with further embodiments of the present invention are possible in light of the above teachings. It is therefore to be understood that within the scope of the appended claims the invention may be practiced other than as specifically described herein.

What is claimed is:

1. A powder supply device, comprising:

a powder storage storing a powder;

a powder discharge part adapted to discharge the powder from the powder storage to a powder container, the powder discharge part being communicatable with the powder storage and connectable to the powder container; and an air suction part adapted to suck an air from the powder container to generate an air current flowing from the powder storage to the powder container, wherein the air suction part includes:

a hollow body, the hollow body being connectable to the powder container and expandable by elastic restoring force; and a restriction member adapted to restrict expansion of the hollow body, the restriction member being detachably attached to the hollow body.

2. The powder supply device according to claim 1, wherein the air suction part includes a vacuum container, the vacuum container being connectable to the powder container.

3. The powder supply device according to claim 1, wherein a part or whole of the powder storage is transparent or translucent.

4. The powder supply device according to claim 1, wherein the powder discharge part is closable with a seal member.

5. The powder supply device according to claim 1, wherein the powder discharge part is opened and the air suction part is brought into operation in conjunction with an attachment action of the powder discharge part to the powder container, and the powder discharge part is closed and the air suction part is brought into stop in conjunction with a detachment action of the powder discharge part from the powder container.

6. The powder supply device according to claim 1, wherein the air suction part includes an air suction path, the air suction path having at least one filter member adapted to avoid passage of the powder through the air suction path.

7. The powder supply device according to claim 1, wherein the powder stored in the powder storage includes toner particles having an average particle diameter of 5 μm and a circularity of 0.98 or more, the toner particles including 100 parts by weight of mother toner particles and 1.5 parts by weight or more of inorganic fine particles having a primary average particle diameter of 7 to 30 nm.

8. The powder supply device according to claim 7, wherein the inorganic fine particles include a silicone-oil-containing silica.

9. A developing device, comprising:

a powder container; and the powder supply device according to claim 1, wherein the powder stored in the powder storage includes toner particles.

10. An image forming apparatus, comprising:

an image bearing member adapted to bear a latent image; and a developing device according to claim 9, the developing device adapted to develop the latent image into a toner image with the toner particles.

* * * * *